US010232501B2

(12) United States Patent
Sawano et al.

(10) Patent No.: US 10,232,501 B2
(45) Date of Patent: Mar. 19, 2019

(54) POWER TOOL

(71) Applicant: PANASONIC CORPORATION, Osaka (JP)

(72) Inventors: Fumiaki Sawano, Mie (JP); Hidenori Shimizu, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 602 days.

(21) Appl. No.: 14/384,247

(22) PCT Filed: Feb. 19, 2013

(86) PCT No.: PCT/JP2013/000901

§ 371 (c)(1),
(2) Date: Sep. 10, 2014

(87) PCT Pub. No.: WO2013/136668

PCT Pub. Date: Sep. 19, 2013

(65) Prior Publication Data

US 2015/0047867 A1 Feb. 19, 2015

(30) Foreign Application Priority Data

Mar. 13, 2012 (JP) ..... 2012-055964

(51) Int. Cl.
*B25B 23/147* (2006.01)
*B25F 5/00* (2006.01)
(Continued)

(52) U.S. Cl.
CPC ..... *B25F 5/001* (2013.01); *B25B 21/00* (2013.01); *B25B 23/14* (2013.01); *B25B 23/141* (2013.01); *B25B 23/147* (2013.01); *B25F 3/00* (2013.01)

(58) Field of Classification Search
USPC ..... 173/217
See application file for complete search history.

(56) References Cited

U.S. PATENT DOCUMENTS 4,084,487 A 4/1978 Wallace
5,277,527 A 1/1994 Yokota et al.
(Continued)

FOREIGN PATENT DOCUMENTS

CN 2547073 Y 4/2003
CN 1531306 A 9/2004
(Continued)

OTHER PUBLICATIONS

Chinese Office Action dated Apr. 23, 2015 issued in Chinese Patent Application No. 201380013428.3 (English translation thereof).
(Continued)

*Primary Examiner* — Michelle Lopez
*Assistant Examiner* — Chinyere Rushing-Tucker
(74) *Attorney, Agent, or Firm* — McDermott Will & Emery LLP

(57) ABSTRACT

A power tool that is capable of more reliably keeping a torque at a constant is provided. An adjustment member is provided with: an engagement hole that is detachably attached to the adjustment member, and serves as an engagement part that engages with a torque adjustment device that serves as a clutch handle for rotating the adjustment member; and a lid that is attached to an opening in such a manner as to cover the engagement hole.

11 Claims, 6 Drawing Sheets

(51) Int. Cl.

| | |
|---|---|
| ***B25B 21/00*** | (2006.01) |
| ***B25B 23/14*** | (2006.01) |
| ***B25F 3/00*** | (2006.01) |

(56) References Cited

U.S. PATENT DOCUMENTS

| | | | | |
|---|---|---|---|---|
| 5,655,421 | A | 8/1997 | Haupt | |
| 2004/0180703 | A1 | 9/2004 | Kim et al. | |
| 2006/0118380 | A1* | 6/2006 | Aeberhard | B25B 23/141 192/56.61 |
| 2007/0132196 | A1* | 6/2007 | Puzio | B23B 31/1253 279/2.21 |
| 2007/0201748 | A1* | 8/2007 | Bixler | B25F 5/001 382/225 |
| 2008/0060487 | A1* | 3/2008 | Schell | B25B 23/1456 81/469 |
| 2008/0210450 | A1* | 9/2008 | Spielmann | B25F 5/001 173/178 |
| 2009/0101376 | A1* | 4/2009 | Walker | B25B 21/00 173/47 |
| 2011/0017484 | A1* | 1/2011 | Roehm | B23B 45/008 173/178 |
| 2011/0127059 | A1* | 6/2011 | Limberg | F16D 7/044 173/216 |
| 2015/0000951 | A1* | 1/2015 | Hecht | B25F 5/00 173/213 |
| 2016/0318165 | A1* | 11/2016 | Thorson | B25B 23/147 |

FOREIGN PATENT DOCUMENTS

| | | | |
|---|---|---|---|
| CN | 101096099 | A | 1/2008 |
| EP | 0755755 | A2 | 1/1997 |
| JP | 08-276372 | A | 10/1996 |
| JP | 10-329046 | A | 12/1998 |
| JP | 2001-239468 | A | 9/2001 |
| JP | 2002-127034 | A | 5/2002 |

OTHER PUBLICATIONS

International Preliminary Report on Patentability and Written Opinion issued in International Application No. PCT/JP2013/000901 dated Sep. 16, 2014.

International Search Report issued in International Application No. PCT/JP2013/000901 dated May 14, 2013, with English translation.

European Search Report dated Sep. 21, 2015 issued in European Patent Application No. 13762034.0.

* cited by examiner

POWER TOOL

RELATED APPLICATIONS

This application is the U.S. National Phase under 35 U.S.C. § 371 of International Application No. PCT/JP2013/000901, filed on Feb. 19, 2013, which in turn claims the benefit of Japanese Application No. 2012-055964, filed on Mar. 13, 2012, the disclosures of which are incorporated by reference herein.

TECHNICAL FIELD

The present invention relates to a power tool that includes a torque adjustment function.

BACKGROUND ART

In the prior art, power tools such as an impact wrench and a power driver that are powered by motors have been proposed.

In such power tools, patent document 1 describes a known power tool including a torque adjustment function that adjusts a tightening torque used to tighten a screw or the like. In the power tool of patent document 1, for example, a dedicated torque adjuster is used to rotate a torque adjustment portion and adjust the torque adjuster.

PRIOR ART DOCUMENT

Patent Document

Patent Document 1: Japanese Laid-Open Patent Publication No. 8-276372

SUMMARY OF THE INVENTION

Problems that are to be Solved by the Invention

To control the torque from the aspect of quality control, it is desirable that the torque be adjusted with only a torque adjuster. In the above power tool, however, a user may manually turn the torque adjustment portion without using the torque adjuster. Thus, there is room for improvement from the aspect of torque control.

It is an object of the present invention to provide a power tool that certainly maintains a regulated torque.

Means for Solving the Problem

To solve the above problem, a power tool of the present invention includes a driving source, a drive transmission mechanism that transmits driving power from the driving source, a torque adjustment portion capable of adjusting a tightening torque for when the driving power is transmitted to an output portion, and a main body housing accommodating the driving source, the drive transmission mechanism, and the torque adjustment portion, wherein the main body housing includes an opening that exposes the output portion. The torque adjustment portion includes a torque clutch including a clutch spring and a clutch plate, which abuts against a first end portion of the clutch spring, wherein the torque clutch is configured to interrupt power transmission to the output portion by pushing and lifting the clutch plate against the clutch spring as a load torque on the output portion increases, and an adjustment member arranged at a second end portion of the clutch spring in the torque clutch.

The torque adjustment portion is configured to adjust a spring force of the clutch spring that pushes the clutch plate to change the degree of the tightening torque when interrupting power transmission of the torque clutch. The adjustment member includes an engagement portion engaged with a clutch handle, which is coupled in a removable manner to the adjustment member to rotate the adjustment member, and a cover attached to the opening to cover the engagement portion.

In the above structure, preferably, the power tool includes the clutch handle, which rotates the adjustment member, and the cover includes a cover side engagement portion, which is formed in a rotating direction of the cover and engaged with the clutch handle. Preferably, the cover is configured so that the cover is removable from the main body housing by engaging the cover potion side engagement portion with the clutch handle.

In the above structure, preferably, the cover includes a cover side engagement portion, which is formed in a rotating direction of the cover and engaged with the clutch handle, and the cover is configured to be removable from the main body housing by engaging the cover potion side engagement portion with the clutch handle.

In the above structure, preferably, the engagement portion includes a plurality of primary engagement elements continuously formed in a rotating direction of the adjustment member, the cover side engagement portion includes a plurality of secondary engagement elements continuously formed in the rotating direction of the cover, and the primary engagement elements differ in shape from the secondary engagement elements.

In the above structure, preferably, the primary engagement elements have a curved shape, and the secondary engagement elements have a cylindrical shape.

In the above structure, preferably, the primary engagement elements have a cylindrical shape, and the secondary engagement elements have a curved shape.

EFFECTS OF THE INVENTION

The present invention provides a power tool that further ensures that the torque is maintained at a constant value.

EMBODIMENTS OF THE INVENTION

One embodiment of a power tool of the present invention will now be described with reference to the drawings.

Figure 1:
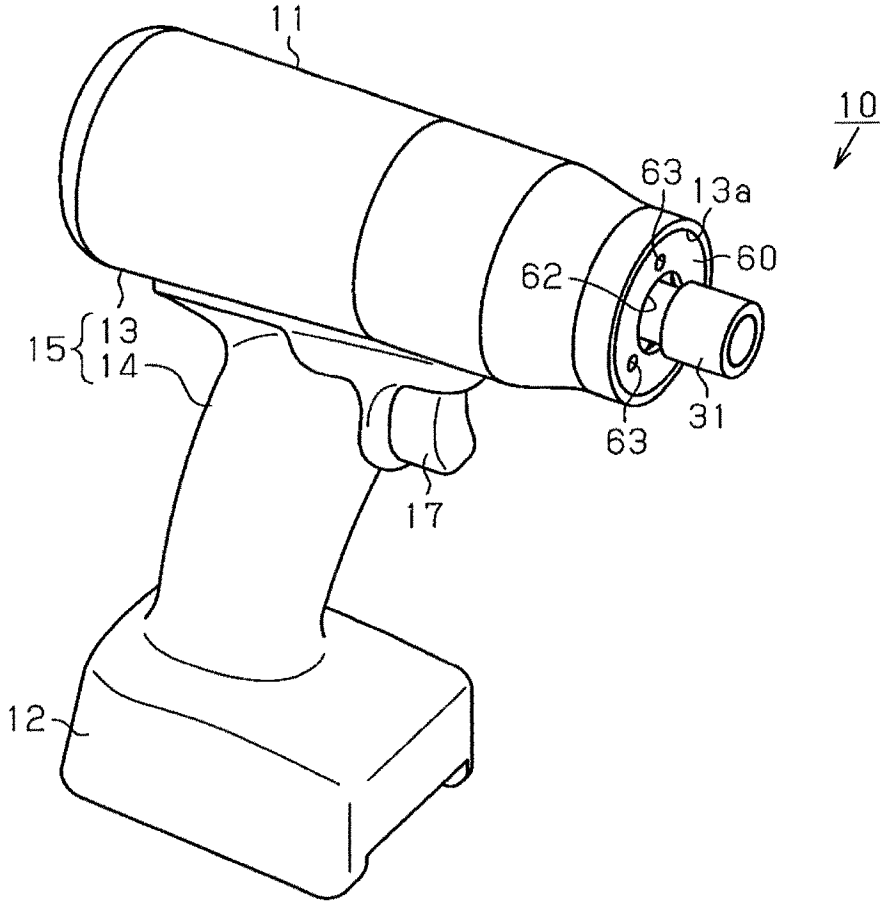
FIG. 1 is a perspective view of a power tool in one embodiment.
Figure 2:
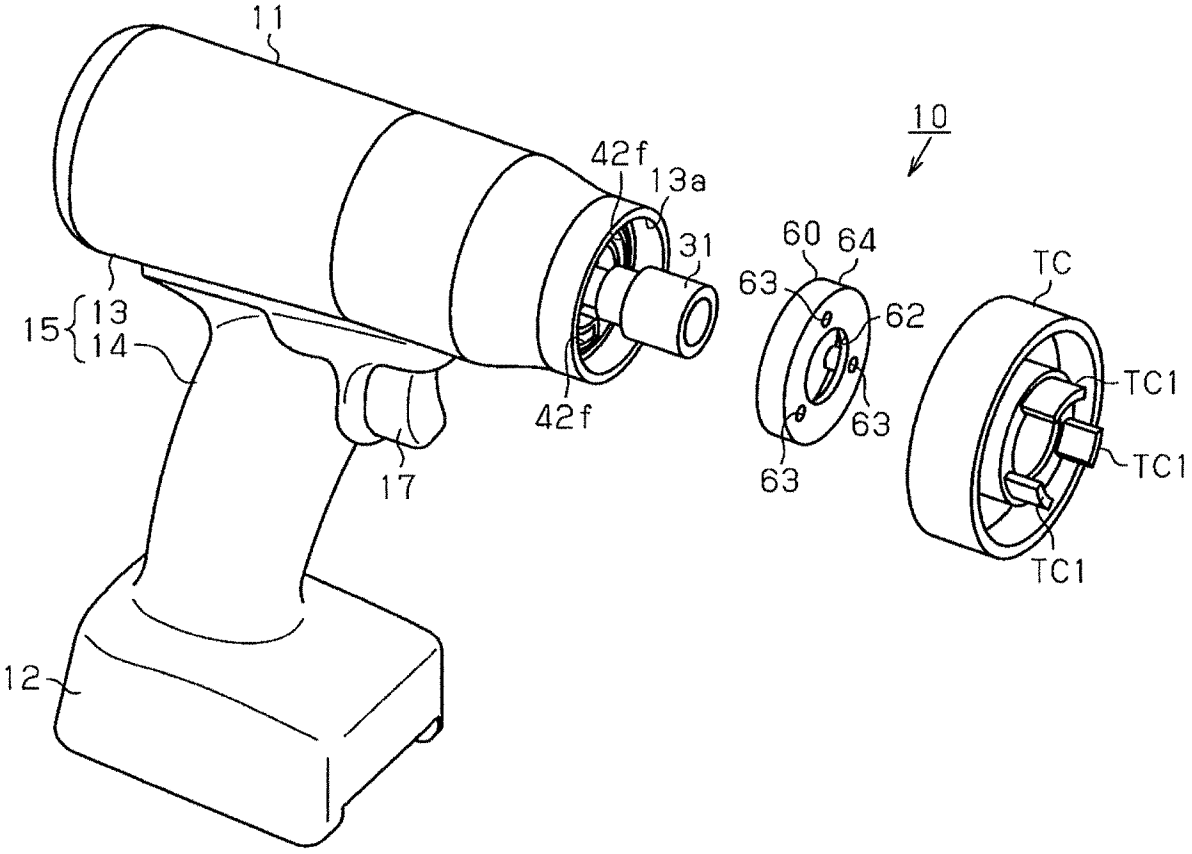
FIG. 2 is a perspective view of the power tool and a torque adjustment tool in the embodiment.

As shown in FIGS. 1 and 2, a power tool 10 of the present embodiment includes a tool main body 11 and a battery pack 12, which is coupled in a removable manner to the tool main body 11. The tool main body 11 includes a generally T-shape main body housing 15 formed from a generally cylindrical body portion 13 and a grip portion 14, which extends downward from an intermediate position of the body portion 13 in the longitudinal direction.

Figure 3:
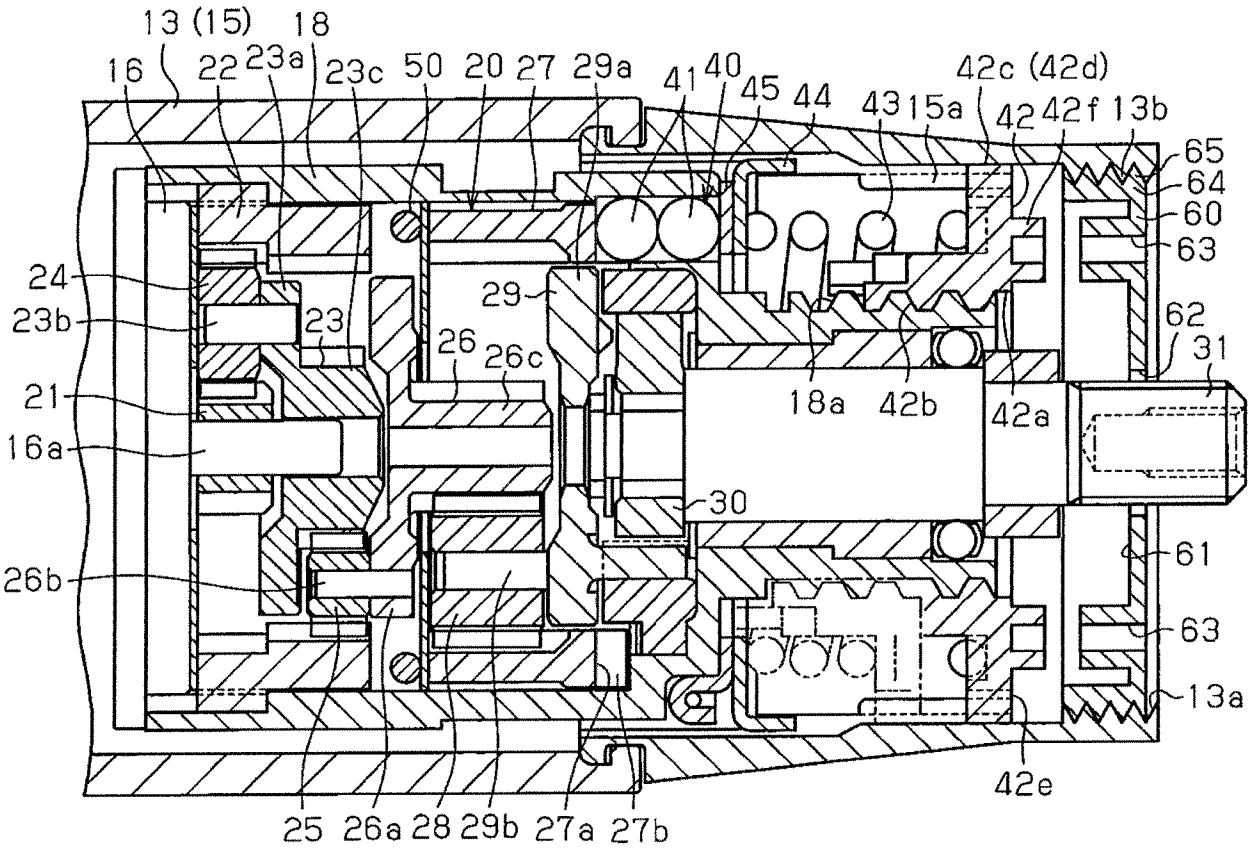
FIG. 3 is a cross-sectional view of a gear unit in the embodiment.
Figure 4:
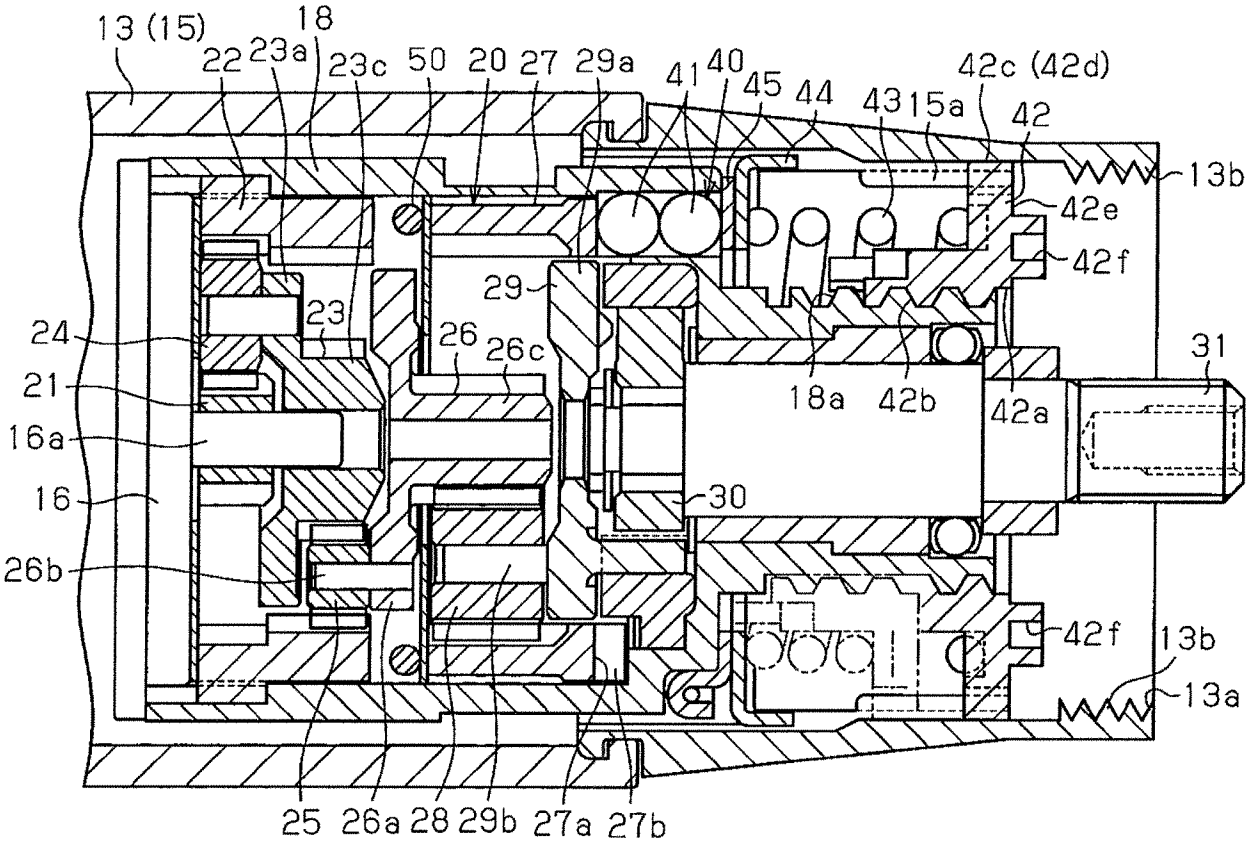
FIG. 4 is a cross-sectional view of the gear unit in the embodiment.

As shown in FIGS. 3 and 4, a motor 16, which functions as a driving source, is accommodated in a rearward position of the body portion 13 of the main body housing 15 in the longitudinal direction.

As shown in FIG. 1, the grip portion 14 includes a trigger switch 17, which functions as an operation instruction unit with which an operator instructs activation or deactivation of the power tool 10. A user operates the trigger switch 17 to adjust the rotation speed of the motor 16.

As shown in FIGS. 3 and 4, the main body housing 15 accommodates a generally cylindrical gear case 18. The gear case 18 accommodates a three-stage planetary gear mechanism 20, which is coupled to and driven by the motor 16 and which decelerates the output from the motor 16, and a torque clutch 40, which is used to adjust a tightening torque.

The planetary gear mechanism 20 will now be described.

A rotation shaft 16*a* of the motor 16 includes a sun gear 21, which integrally rotates with the rotation shaft 16*a*. The rotation shaft 16*a* is fitted to a large diameter portion 23*a* of a first transmission gear 23. The large diameter portion 23*a* of the first transmission gear 23 is fitted to a support shaft 23*b*. A first planetary gear 24, which is supported by the support shaft 23*b* and located between the sun gear 21 and a ring gear 22 fixed to an inner circumferential surface of the gear case 18, is meshed with the sun gear 21. Thus, when the rotation shaft 16*a* rotates, the first planetary gear 24 rotates about the support shaft 23*b* and revolves around the sun gear 21, which rotates integrally with the rotation shaft 16*a*.

A second planetary gear 25 is meshed with a small diameter gear unit 23*c* of the first transmission gear 23 and located between the small diameter gear unit 23*c* of the first transmission gear 23 and the ring gear 22. The second planetary gear 25 is supported by a support shaft 26*b*, which is fitted to a large diameter portion 26*a* of a second transmission gear 26 that is coaxial with the rotation shaft 16*a*. When the rotation shaft 16*a* rotates, the second planetary gear 25 rotates about the support shaft 26*b* and revolves around the small diameter gear unit 23*c* of the first transmission gear 23.

In the same manner as the first transmission gear 23, the second transmission gear 26 includes a small diameter gear unit 26*c*. The small diameter gear unit 26*c* is meshed with a third planetary gear 28, which is located between the small diameter gear unit 26*c* and a ring gear 27 arranged in the gear case 18 and capable of rotating freely. The third planetary gear 28 is supported by a support shaft 29*a*, which is fitted to a third transmission gear 29 that is coaxial with the axis of the rotation shaft 16*a*. When the rotation shaft 16*a* rotates, the third planetary gear 28 rotates about the support shaft 29*a* and revolves around the small diameter gear unit 26*c* of the second transmission gear 26.

The third transmission gear 29 is coupled to an output shaft 31 through a lock plate 30, which forms a lock mechanism. Here, the lock mechanism that performs automatic locking when a manual operation is performed will not be described.

The torque clutch 40, which is used to adjust a tightening torque, uses the ring gear 27, which is capable of rotating freely in a third stage planetary mechanism. The torque clutch 40 includes a protrusion 27*b*, which is formed on an end surface 27*a* of the ring gear 27 located at the side of the output shaft 31 in the axial direction, balls 41, which are engaged with the protrusion 27*b* in the rotational direction, an adjustment member 42, which is located on an outer circumferential surface of a distal end portion of the gear case 18 that has a relatively small diameter, and a clutch spring 43, which is elastically connected to the balls 41. One end of the clutch spring 43 is elastically connected to the adjustment member 42. The other end of the clutch spring 43 is connected to the balls 41 through a click plate 44 and clutch plate 45. The annular clutch plate 45, which is located between the click plate 44 and the balls 41, is attached to the gear case 18 so that rotation is restricted relative to the gear case 18 and movement is permitted in the axial direction.

The adjustment member 42 is formed to be disc-shaped. A hole extends through a central portion of the adjustment member 42 in the axial direction. An inner circumferential surface 42*a* of the adjustment member 42 includes an internal threaded portion 42*b*, which is screwed with an external threaded portion 18*a* formed on an outer circumferential surface of a small diameter portion of the gear case 18. An outer circumferential surface 42*c* of the adjustment member 42 includes a protrusion 42*d*, which protrudes outward in the radial direction of the adjustment member 42. As shown in FIGS. 3 and 4, the protrusion 42*d* is slidably engaged with a longitudinal recess portion 15*a* formed on an inner surface of the main body housing 15 in the axial direction. Thus, the adjustment member 42 is moved forward or backward relative to the gear case 18 in the axis (thrust) direction when screwed.

The operation of the torque clutch 40 will now be described.

The output of the motor 16 is decelerated and transmitted to the output shaft 31 by a first stage planetary mechanism, a second stage planetary mechanism, and a third stage planetary mechanism. The third stage planetary mechanism includes the ring gear 27 of which rotation is inhibited by the balls 41 that are urged and locked by the clutch spring 43. When a load torque applied to the ring gear 27 exceeds the engagement force between the balls 41, which are urged by the clutch spring 43, and the protrusion 27*b* of the ring gear 27, the ring gear 27 pushes the balls 41 against the clutch spring 43 and starts to rotate freely. Thus, the torque clutch, which includes the ring gear 27 and the balls 41, slips and regulates the tightening torque.

When the adjustment member 42 is rotated and moved downward as viewed in FIG. 3 to compress the clutch spring 43, the engagement force increases between the balls 41 and the ring gear 27. This increases the load torque at which the ring gear 27 starts to rotate freely. When the adjustment member 42 is moved to a location where the adjustment member 42 contacts the clutch plate 45, the balls 41, which are pushed by the protrusion 27*b*, and cannot move backward. In this case, the slipping torque of the torque clutch becomes infinite, which is suitable in an electric drill. The thrust force applied to the ring gear 27 from the clutch spring 43 is received by a thrust receiving pin 50, which extends through the gear case 18.

Figure 5:
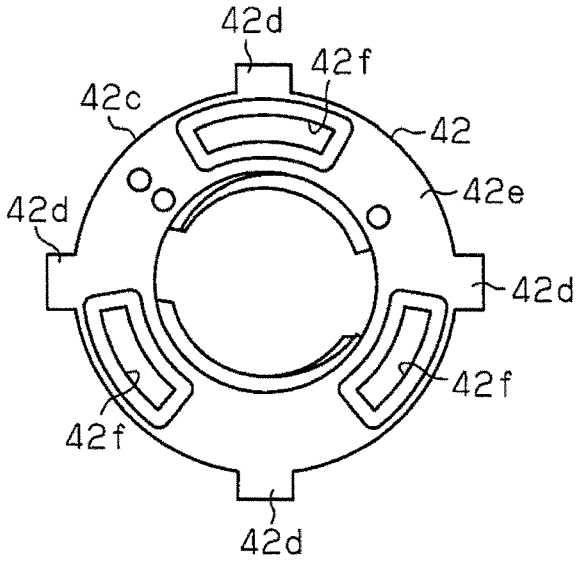
FIG. 5 is a plan view of an adjustment member in the embodiment.

As shown in FIGS. 3 to 5, in the present embodiment, a front surface 42*e* of the adjustment member 42, which is located at the side of the output shaft 31 in the axial direction, includes three engagement holes 42*f*, which are formed at generally equal intervals in the rotational direction. Each of the engagement holes 42*f* is formed to be curved as viewed from the axial direction.

Figure 6A:
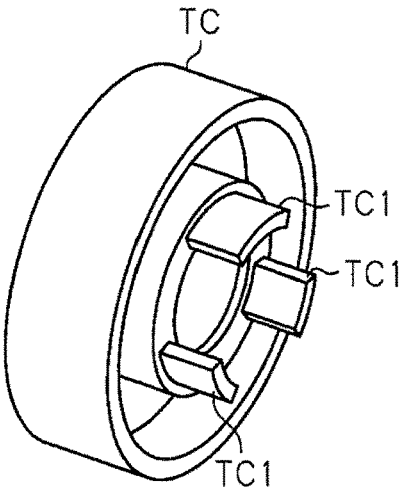
FIGS. 6A and 6B are diagrams of a toque adjustment tool.
Figure 6B:
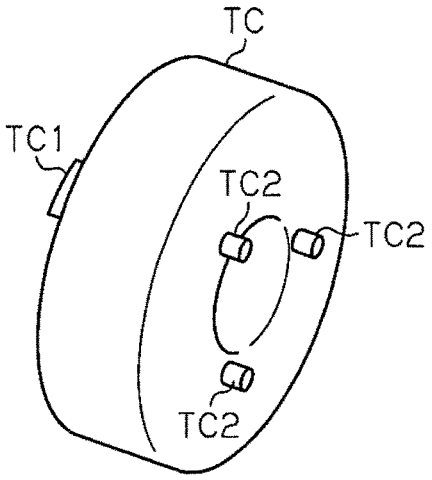

As shown in FIG. 6, one end of a torque adjuster TC (clutch handle), which is discrete from the power tool 10, includes engagement protrusions TC1. The engagement protrusions TC1 are fitted into the engagement holes 42*f*, and the torque adjuster TC is rotated to revolve the engagement holes 42*f*. Accordingly, as described above, the adjustment member 42 revolves and moves in the axial direction to change the compression force of the clutch spring 43 and change the engagement force between the ball 41 and the ring gear 27. This adjusts the tightening torque.

Additionally, the power tool 10 of the present embodiment includes a cover 60, which closes an opening 13*a* formed in one end of the body portion 13 of the main body housing 15 in the longitudinal direction so that a user cannot easily touch the adjustment member 42. The cover 60 is cylindrical and has a closed end. The central position in a bottom portion 61 of the cover 60 includes an insertion hole 62, through which the output shaft 31 is inserted. In the cover 60, three cylindrical insertion holes 63 extend around the insertion hole 62 from the bottom portion 61 toward an opening of the cover 60. An outer circumferential surface 64 of the cover 60 includes an external threaded portion 65. An inner circumferential surface of the opening 13*a* in the body portion 13 includes an internal threaded portion 13*b*. The cover 60 is attached to the opening 13*a* in such a manner that the cover 60 closes the opening 13*a* by fastening the external threaded portion 65 with the internal threaded portion 13*b*.

Three cylindrical protrusions TC2, which are formed on the other end of the torque adjuster TC, are fitted to the insertion holes 63 of the cover 60. Thus, the cover 60 is configured to be rotatable by the torque adjuster TC. That is, the cover 60 is configured to be coupled in a removable manner to the opening 13*a*.

In the power tool 10 having the above structure, a sequence of the adjustment method (operation) during torque adjustment will now be described.

In the power tool 10 having the above structure, the cover 60 is attached to the opening 13*a* of the body portion 13 of the main body housing 15. Thus, due to the cover 60, torque adjustment cannot be performed with the torque adjuster TC.

Therefore, a user first fits (engages) the cylindrical protrusion TC2 formed on the torque adjuster TC into (with) the insertion hole 63 of the cover 60 and then rotates the torque adjuster TC about the axis of the output shaft 31. This rotates the cover 60 and gradually moves the cover 60 toward the outer side to eventually remove the cover 60 from the opening 13*a*.

The engagement protrusions TC1 of the torque adjuster TC are inserted from the opening 13*a* in the axial direction to fit (engage) the engagement protrusions TC1 into (with) the engagement holes 42*f* of the adjustment member 42 in the body portion 13 (main body housing 15). When the torque adjuster TC is rotated about the axis in the same manner as described above, the adjustment member 42 is rotated and moved in the axial direction to change the compression force of the clutch spring 43. This changes the engagement force between the balls 41 and the ring gear 27 and adjusts the tightening torque.

The advantages of the present embodiment will now be described.

(1) The adjustment member 42 includes the engagement holes 42*f* and the cover 60, which covers the engagement holes 42*f* when closing the opening 13*a*. Each of the engagement holes 42*f* functions as an engagement portion that engages with the torque adjuster TC, which serves as a clutch handle and is coupled in a removable manner to the adjustment member 42 to rotate the adjustment member 42. In this structure, the adjustment member 42 is covered (concealed) to restrict a user from changing the torque without the torque adjuster TC. This further ensures that the torque is maintained at a constant value.

(2) The cover 60 includes the torque adjuster TC, which rotates the adjustment member 42, and the insertion holes 63, each of which functions as a cover side engagement portion for engagement in the rotation direction of the cover 60. The cover 60 is configured so that engagement of the torque adjuster TC with the insertion holes 63 allows the cover 60 to be removed from the main body housing 15. In this manner, the cover 60 may be removed from the main body housing 15 using the torque adjuster TC. Thus, there is no need for a jig or the like other than the torque adjuster TC when removing the cover 60 from the main body housing 15 during torque adjustment. This improves convenience during torque adjustment and allows for easy torque adjustment.

The embodiment of the present invention may be modified as described below.

Figure 7:
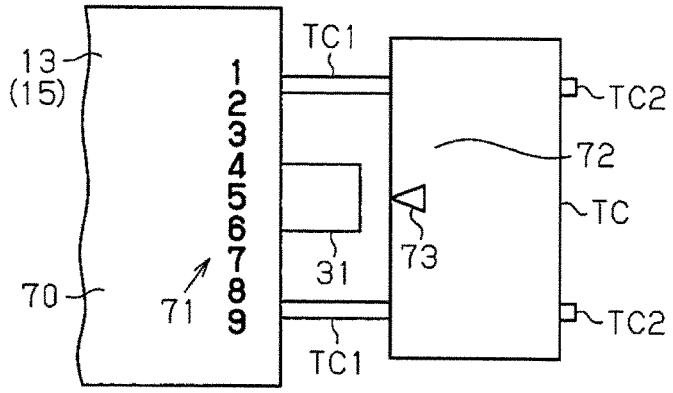
FIG. 7 is a side view of a power tool and a torque adjustment tool of a modified example.
Figure 8:
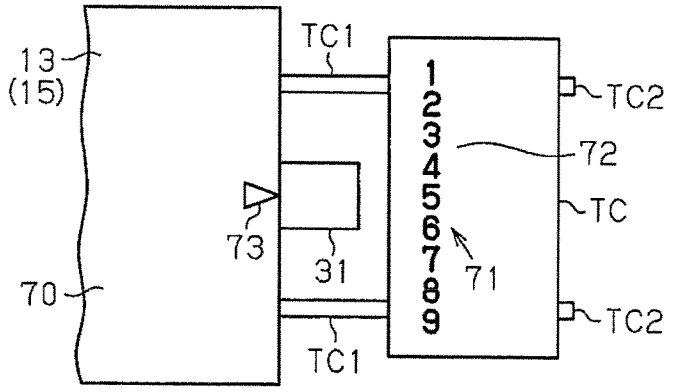
FIG. 8 is a side view of a power tool and a torque adjustment tool of a modified example.

Although not particularly referred to in the foregoing description, in the above embodiment, for example, a structure for indicating the level of the torque adjustment to the user may be employed. For example, as shown in FIG. 7, an exterior surface 70 of the body portion 13 of the main body housing 15 includes an index 71 indicating numerical levels of the torque adjustment (numerical characters 1 to 9 are illustrated in the drawing), and an exterior surface 72 of the torque adjuster TC includes a mark 73 (indicated by a triangular mark in the drawing) associated with the index 71. Alternatively, as shown in FIG. 8, the exterior surface 72 of the torque adjuster TC includes the index 71 indicating numerical levels of the torque adjustment, and the exterior surface 70 of the body portion 13 of the main body housing 15 includes the mark 73 associated with the index 71. By using this structure, the level of the torque adjustment is indicated to the user during the torque adjustment.

Figure 9:
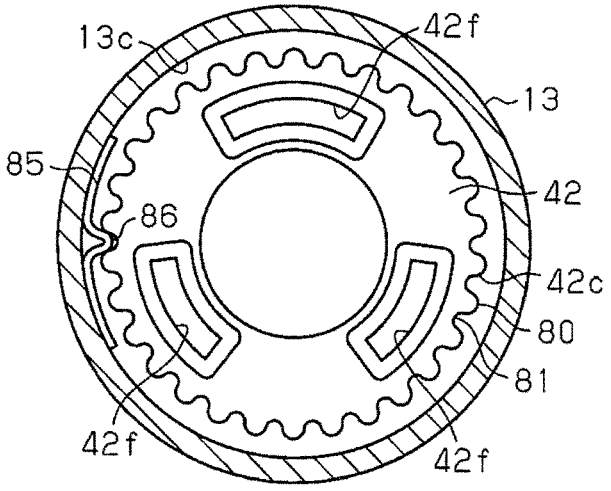
FIG. 9 is a plan view of an adjustment member of a modified example.

The structure of the adjustment member 42 may be modified as follows. As shown in FIG. 9, an outer circumferential surface 42*c* of the adjustment member 42 includes protrusions 80 and recesses 81 formed continuously in the radial direction so that the recesses 81 are engage with a spring protrusion 86 of a plate spring 85, which is arranged on an inner circumferential surface 13*c* of the body portion 13 of the main body housing 15. This structure limits changes in the set torque that may be caused by an impact generated in the power tool 10.

In the above embodiment, the present invention is applied to a power tool including the battery pack 12, that is, a rechargeable power tool. Instead, the present invention may be applied to a power tool powered by an AC power source.

In the above embodiment, the engagement holes 42*f* are curved as viewed from the axial direction, and the insertion holes 63 are cylindrical. However, the shapes of the engagement holes 42*f* and the insertion holes 63 are not particularly limited as long as the engagement holes 42*f* and the insertion holes 63 can be engaged with the engagement protrusions TC1 and TC2 of the clutch handle TC.

The invention claimed is:

1. A power tool comprising:

a driving source;

a drive transmission mechanism that transmits driving power from the driving source;

a torque adjustment portion capable of adjusting a tightening torque for when the driving power is transmitted to an output portion of the power tool; and a main body housing accommodating the driving source, the drive transmission mechanism, and the torque adjustment portion, wherein the main body housing includes an opening that exposes the output portion and a distal end surface of an adjustment member, the distal end surface is located in the opening, wherein the torque adjustment portion includes:

a torque clutch including a clutch spring and a clutch plate, which abuts against a first end portion of the clutch spring, wherein the torque clutch is configured to interrupt power transmission to the output portion by pushing and lifting the clutch plate against the clutch spring as a load torque on the output portion increases, and the adjustment member, which is arranged at a second end portion of the clutch spring in the torque clutch, wherein the torque adjustment portion is configured to adjust a spring force of the clutch spring that pushes the clutch plate to change the degree of the tightening torque when interrupting power transmission of the torque clutch, and the adjustment member includes an engagement portion disposed on the distal end surface, the engagement portion being engagable with a clutch handle, which is configured to be coupled in a removable manner to the adjustment member to rotate the adjustment member, the power tool further comprising:

a cover configured to be removably attached to the opening to cover the engagement portion, wherein the distal end surface is an outermost surface of the adjustment member taken along a longitudinal axis of the output portion, and wherein the cover prevents the clutch handle from engaging the engagement portion of the adjustment member when the cover is attached to the opening of the main body housing.

2. The power tool according to claim 1, wherein the power tool includes the clutch handle, which rotates the adjustment member, and the cover includes a cover side engagement portion, which is formed in a rotating direction of the cover and engaged with the clutch handle, wherein the cover is configured so that the cover is removable from the main body housing by engaging the cover side engagement portion with the clutch handle.

3. The power tool according to claim 2, wherein the engagement portion includes a plurality of primary engagement elements continuously formed in a rotating direction of the adjustment member, the cover side engagement portion includes a plurality of secondary engagement elements continuously formed in the rotating direction of the cover, and the primary engagement elements differ in shape from the secondary engagement elements.

4. The power tool according to claim 3, wherein the primary engagement elements have a curved shape, and the secondary engagement elements have a cylindrical shape.

5. The power tool according to claim 3, wherein the primary engagement elements have a cylindrical shape, and the secondary engagement elements have a curved shape.

6. The power tool according to claim 1, wherein the cover includes a cover side engagement portion, which is formed in a rotating direction of the cover and engaged with the clutch handle, and the cover is configured to be removable from the main body housing by engaging the cover side engagement portion with the clutch handle.

7. The power tool according to claim 1, wherein the distal end surface of the adjustment member defines a plane that extends perpendicular to the longitudinal axis of the output portion.

8. The power tool according to claim 1, wherein the distal end surface of the adjustment member is positioned between a distal end of the output portion and the torque clutch.

9. The power tool according to claim 1, wherein the engagement hole of the adjustment member is open to at least distal end side of the output portion.

10. The power tool according to claim 1, wherein the plurality of engagement holes of the adjustment member are continuously formed in a rotating direction of the adjustment member.

11. The power tool according to claim 1, wherein the distal end surface of the adjustment member is fully recessed within the opening of the main body.

* * * * *